US011512431B2

(12) United States Patent
Cecchini et al.

(10) Patent No.: US 11,512,431 B2
(45) Date of Patent: Nov. 29, 2022

(54) METHOD OF FORMING A THREE-LAYER BOARD WEB AND A FORMING SECTION OF FORMING A THREE-LAYER BOARD WEB

(71) Applicant: Valmet Technologies Oy, Espoo (FI)

(72) Inventors: Juan Cecchini, Jyväskylä (FI); Juha Kivimaa, Muurame (FI); Kari Lamminmäki, Jyväskylä (FI); Antti Poikolainen, Jyväskylä (FI)

(73) Assignee: Valmet Technologies Oy, Espoo (FI)

( * ) Notice: Subject to any disclaimer, the term of this patent is extended or adjusted under 35 U.S.C. 154(b) by 0 days.

(21) Appl. No.: 16/910,242

(22) Filed: Jun. 24, 2020

(65) Prior Publication Data

US 2020/0407916 A1 Dec. 31, 2020

(30) Foreign Application Priority Data

Jun. 27, 2019 (FI) ..... 20195568

(51) Int. Cl.
*D21F 11/04* (2006.01)
*D21F 9/00* (2006.01)
*D21F 9/02* (2006.01)

(52) U.S. Cl.
CPC ..... *D21F 11/04* (2013.01); *D21F 9/006* (2013.01); *D21F 9/02* (2013.01)

(58) Field of Classification Search
CPC . D21F 11/04; D21F 9/006; D21F 9/02; D21F 1/52; D21F 1/08; D21F 11/08; D21F 1/022; D21F 1/48; D21F 9/003; D21F 1/02; D21F 9/00
See application file for complete search history.

(56) References Cited

U.S. PATENT DOCUMENTS 4,477,313 A 10/1984 Andersson

FOREIGN PATENT DOCUMENTS

| | | | | |
|---|---|---|---|---|
| DE | 202004021817 U1 * | 6/2011 | ..... | D21F 9/006 |
| EP | 2784213 A1 * | 10/2014 | ..... | D21F 1/026 |
| EP | 2784213 A1 | 10/2014 | | |
| EP | 2841643 A1 * | 3/2015 | ..... | D21F 1/523 |
| EP | 2841643 A1 | 3/2015 | | |
| EP | 1543194 B1 | 12/2017 | | |
| WO | 02092908 A1 | 11/2002 | | |
| WO | WO-2009068728 A1 * | 6/2009 | ..... | D21F 9/006 |
| WO | 2010020707 A1 | 2/2010 | | |
| WO | 2018229333 A1 | 12/2018 | | |

* cited by examiner

*Primary Examiner* — Eric Hug
*Assistant Examiner* — Matthew M Eslami
(74) *Attorney, Agent, or Firm* — James Earl Lowe, Jr.

(57) ABSTRACT

The invention relates to a method for forming a three-layer board web, preferably a folding box board (FBB) or a solid bleached (sulfate) board (SBS), in a forming section (300) comprising a multilayer headbox (100) and a forming unit (200). In the method the layers of the three-layer board web are first formed of pulp suspension in the multilayer headbox (100) and fed to only one forming unit (200), a gap former where the pulp suspension from the multilayer headbox is fed to a gap between lower and upper wires for water removal and for joining the layers of the three-layer board web and where water is first removed by a non-pulsating forming shoe (37, 39).

3 Claims, 4 Drawing Sheets

METHOD OF FORMING A THREE-LAYER BOARD WEB AND A FORMING SECTION OF FORMING A THREE-LAYER BOARD WEB

TECHNICAL FIELD

The invention relates generally to producing three-layer board webs. Particularly the invention relates to a method of forming a three-layer board web and to a forming section of forming a three-layer board web.

BACKGROUND

As known from the prior art in fiber web machines, especially in paper and board machines, the fiber web is produced and treated in an assembly formed by a number of apparatuses arranged consecutively in a process line. A typical production and treatment line comprise a forming section comprising a headbox and a forming unit and a press section as well as a subsequent drying section and a reel-up. The production and treatment line can further comprise other devices and sections for finishing the fiber web, for example, a size press, a calender, a coating section. The production and treatment line also comprise typically at least one winder for forming customer rolls as well as a roll packaging apparatus.

The task of the headbox is to supply fiber suspension for the fiber web production into the forming unit. In a multilayer headbox more than one fiber suspension flows are discharged from the headbox via flow channels for pulp suspension layers, each for forming one layer of a multiply fiber web.

The task of a forming unit is to remove water from fiber suspension fed by the headbox. When the web is manufactured of watery fiber stock, water in the stock is removed on the forming section through a forming wire or forming wires for starting the formation of the web. Fibers remain on the forming wire or between the forming wires moving together. Depending on the grade of the web being manufactured, different types of stocks are used. The volume for which water can be removed from different stocks for achieving a web of good quality is a function of many factors, such as e.g. a function of the desired basis weight of the web, the design speed of the machine, and the desired level of fines, fibers and fill materials in the finished product. Many types of devices are known on the forming unit such as foil strips, suction boxes, turning rolls, suction rolls, and rolls provided with an open surface, which have been used in many different arrangements and arrays when trying to optimize the volume, time and location of water being removed when forming the web. The manufacturing a high-quality end-product of desired grade is a function of the volume of dewatering, the dewatering method, the duration of dewatering, and the location of dewatering. When it is desired to improve the water removal capacity and to maintain or improve the quality of the end-product, many times unforeseeable problems are created as the result of which either the water removal volume has to be decreased for maintaining the desired quality or the desired quality has to be sacrificed for achieving the greater water volume.

A commonly used method of making a multiply board web is based on the use of several separate web forming units in which the different layers of the web are caused to be drained in a layer by layer fashion either onto one another or onto separate wires, in which case they are combined with one another after partial dewatering. Typically in multiply/multilayer fiber web production i.e. when producing a fiber web having more than one layers term "multiply" is used when the layers are formed separately in the forming section and term "multilayer" is used when a multilayer headbox is used for feeding suspension layers to the forming unit even though these terms multiply/multilayer are used very often synonymously and thus the difference can be defined by the context only.

Fiber webs, especially paper and board are available in a wide variety of types and can be divided according to basis weight in two grades: papers with a single ply and a basis weight of 25-300 g/m$^2$ and boards manufactured in multiply technology and having a basis weight of 150-600 m/m$^2$. It should be noted that the borderline between paper and board is flexible since board grades with lightest basis weights are lighter than the heaviest paper grades. Generally speaking, paper is used for printing and board for packaging. The present invention relates especially to production of three-layer board webs. In particular the invention relates to forming of folding box boards (FBB) and solid bleached (sulfate) boards (SBS). FBB is used for various types of packaging purposes, for example for packaging food, confectionery, cosmetics, pharmaceuticals. The basis weight of FBB is 160-450 g/m$^2$ and it has typically three layers, each surface layer typically has the basis weight of about 45 g/m$^2$. The middle layer is of mechanical pulp to have high bulkiness and the surface layers are made of at least partially bleached chemical pulp. SBS is also used for various types of packaging purposes similar to those of the FBB, especially for chocolate and cigarettes. The SBS has also typically three layers. The middle layer is of hardwood and/or softwood sulfate pulp to have high bulkiness and the surface layers are made of at least partially bleached chemical pulp. The production lines for FBB and SBS have typically a separate headboxes and forming units for each ply. A disadvantage of three fourdrinier forming units is thus caused high energy consumption. The fourdrinier forming units have also relatively low running speed. The production line for FBB also typically has a MG dryer (Yankee cylinder) for surface smoothness and the production line for SBS is typically provided with a wet stack calender for smoothness but bulkiness is reduced simultaneously. Often in production of FBB or SBS multiply board grades problems exists as not strong enough bonding strength between the layers of the multiply board web, which have been tried to be solved by internal sizing with pulp size and by adding starch or other sizing agent between the layers. Middle layer bulkiness and bonding strength between requirements of the layers are typically opposites of each other's, so if middle layer bulkiness is improved typically bonding strength between the layers is weaker.

For both FBB and SBS there exists the need for the surfaces, especially for the top side surface, of the multiply board web to have high surface properties, for example for color, but water removal direction from the middle layer, consisting of mechanical mass, towards the surfaces of the web has an adverse effect as with water also fibers, impurities etc. move towards the surface and reduce the quality of the surfaces and cause adverse visual appearance of the surface.

In EP patent publication 1086271 is disclosed an integrated paper machine which comprises a multilayer headbox and a gap former. This integrated paper machine is provided to produce paper of good quality at a speed that is higher than 2000 meters per minute with length of a paper machine shorter than the length of known paper machines of that time. The multilayer headbox is provided for optimizing the paper quality either by means of formation of fiber layers or by means of formation of layers of admixtures/chemicals in particular in combination with a roll and blade gap former. The gap former is provided to achieve good paper properties (formation, uniformity of basis weight, orientation profile, distributions of fibers, fillers and fines in the direction of thickness, etc.).

In patent publication EP 1543194 is disclosed a twin-wire former for improving filler distribution and anisotropy in the web. The twin-wire former comprises forming wires formed as wire loops with the aid of guiding rolls, breast rolls and hitch rolls and/or other such structures, and in the area of the forming wires are arranged at least two successive dewatering zones, whereby the first dewatering zone in machine direction is formed with the aid of at least one fixed forming shoe provided with a deck having a curved surface, against which forming shoe one of the forming wires is supported while the opposite forming wire is unsupported in the area of the forming shoe and whereby the latter, that is, the second dewatering zone in machine direction is formed by fixed dewatering blades, which are arranged on one side of the forming wires, are located in the cross-machine direction and are supported against the fiber stock located in between the forming wires, and in between the dewatering blades there are gaps, and on the other side of the forming wires dewatering blades. The forming section is a blade type gap former, into the gap of which the lip jet of headbox is directed on to the opposite forming wire located farther away from the fixed forming shoe before the fixed forming shoe, such that the lip jet meets the forming wire, which is supported against the forming shoe, only in the area of the deck of the forming shoe.

An object of the invention is to create a method for forming a three-layer board web and a forming section for a three-layer board web, in which the disadvantages and problems of prior art are eliminated or at least minimized.

An object of the invention is to create a method for forming a folding box board (FBB) web and a forming section for a folding box board (FBB) web, in which the disadvantages and problems of prior art are eliminated or at least minimized.

An object of the invention is to create a method for forming a solid bleached (sulfate) board (SBS) web and a forming section for a solid bleached (sulfate) board (SBS) web, in which the disadvantages and problems of prior art are eliminated or at least minimized.

A particular object of the invention is to create a method for forming a three-layer board web and a forming section for a three-layer board web, in which the disadvantages and problems of prior art relating to infiltration of in view of surface quality of the board web harmful substances, such as impurities and fibers, from the middle layer of the three-layer board web to the surface layers of the three-layer board web are eliminated or at least minimized.

SUMMARY

In order to achieve the above mentioned objects, the forming section according to the invention is mainly characterized by the features of the characterizing clause of the independent forming section claim and the method according to the invention is mainly characterized by the features of the characterizing clause of the independent method claim. Advantageous embodiments and features are disclosed in the dependent claims.

In a gap former pulp suspension from a multilayer headbox is fed to a gap between lower and upper wires. In a combi former pulp suspension from a multilayer headbox is fed to a short one-wire section containing a forming shoe followed by a twin-wire section. One-wire section length in the wire running direction is short, 200-1500 mm, containing only the forming shoe.

According to the invention in the method for forming a three layer board web, preferably a folding box board (FBB) or a solid bleached (sulfate) board (SBS), the three-layer board web is formed in a forming section comprising a multilayer headbox and a forming unit, and in the method the layers of the three-layer board web are first formed of pulp suspension in the multilayer headbox and fed to only one forming unit, which only one forming unit is a gap former, in which gap former pulp suspension from a multilayer headbox is fed to a gap between lower and upper wires, or a combi type twin-wire former, in which combi type former pulp suspension from the multilayer headbox is fed to a short one-wire section containing a forming shoe followed by a twin-wire section, for water removal and for joining the layers of the three-layer board web and water is first removed by a non-pulsating forming shoe.

According to an advantageous feature of the invention in the method white-water is fed between at least two layers of the three-layer board web in an Aqua-headbox.

According to an advantageous feature of the invention in the combi type twin-wire former water is first removed by a short one wire part and length of the one wire part section is 200-1500 mm and that water removal in a twin-wire zone of the twin-wire former starts after the one wire part.

According to an advantageous feature of the invention the non-pulsating forming shoe comprises cross machine direction lists which are arranged after each other with small distance.

According to an advantageous feature of the invention the non-pulsating forming shoe cross direction lists width in machine direction is 4-15 mm and distance between lists is 4-15 mm.

According to the invention the forming section for forming a three layer board web, preferably a folding box board (FBB) or a solid bleached (sulfate) board (SBS), comprises a multilayer headbox and a forming unit, and the forming unit consist of only one forming unit for water removal and for joining the layers of the three-layer board web and the one forming unit is a gap former, in which gap former pulp suspension from a multilayer headbox is fed to a gap between lower and upper wires, or a combi type twin-wire former, in which combi type former pulp suspension from the multilayer headbox is fed to a short one-wire section containing a forming shoe followed by a twin-wire section, and first water removal means comprises a non-pulsating forming shoe.

According to an advantageous feature of the invention the multilayer headbox is an Aqua-headbox comprising at least one Aqua-manifold connected to a corresponding distribution header for feeding white-water between at least two layers of the three-layer board web.

According to an advantageous feature of the invention the combi type twin-wire former comprises as first water removal means a short one wire section with a non-pulsating forming shoe, that length of the one wire section is 200-1500 mm and that a twin-wire section starts after the one wire section.

According to an advantageous feature of the invention the non-pulsating forming shoe comprises cross machine direction lists which are arranged after each other with small distance.

According to an advantageous feature of the invention the non-pulsating forming shoe cross direction lists width in machine direction is 4-15 mm and distance between lists is 4-15 mm.

By the forming section according to the invention many advantages are achieved: Very good layer purity and, if desirable, symmetrical layer purity is achieved, good bonding strength between the layers is achieved. The forming unit has no running speed limitations and thus over 1000 m/min running speeds can be used. For the middle layer of the three-layer board web can be used cheaper pulp and/or pulp with better bulkiness with desired strength depending on the final product need. The first water removal in the forming unit of the forming section is gentle and ensures that the layers do not mix too much or too early. In the forming section water removal happens on both sides of the web in the early phase and by that way good layer purity is ensured on both sides of the web. Space savings are achieved in raw stock and chemicals. Fast closing of the layer inner surfaces provides good remaining of for fine substance and filler in the corresponding layer and thus purity is also improved. According to an advantageous feature of the invention the use of the Aqua-type multilayer headbox the bonding strength between the layers can be controlled and by that way it is possible to use less refined middle layer raw material. Invention decreases manufacturing costs of three-layer board web.

BRIEF DESCRIPTION OF THE DRAWINGS

In the following the invention is explained in detail with reference to the accompanying drawing to which the invention is not to be narrowly limited.

During the course of the following description like numbers and signs will be used to identify like elements according to the different views which illustrate the invention and its advantageous examples. In the figures some repetitive reference signs have been omitted for clarity reasons.

DETAILED DESCRIPTION

Figure 1:
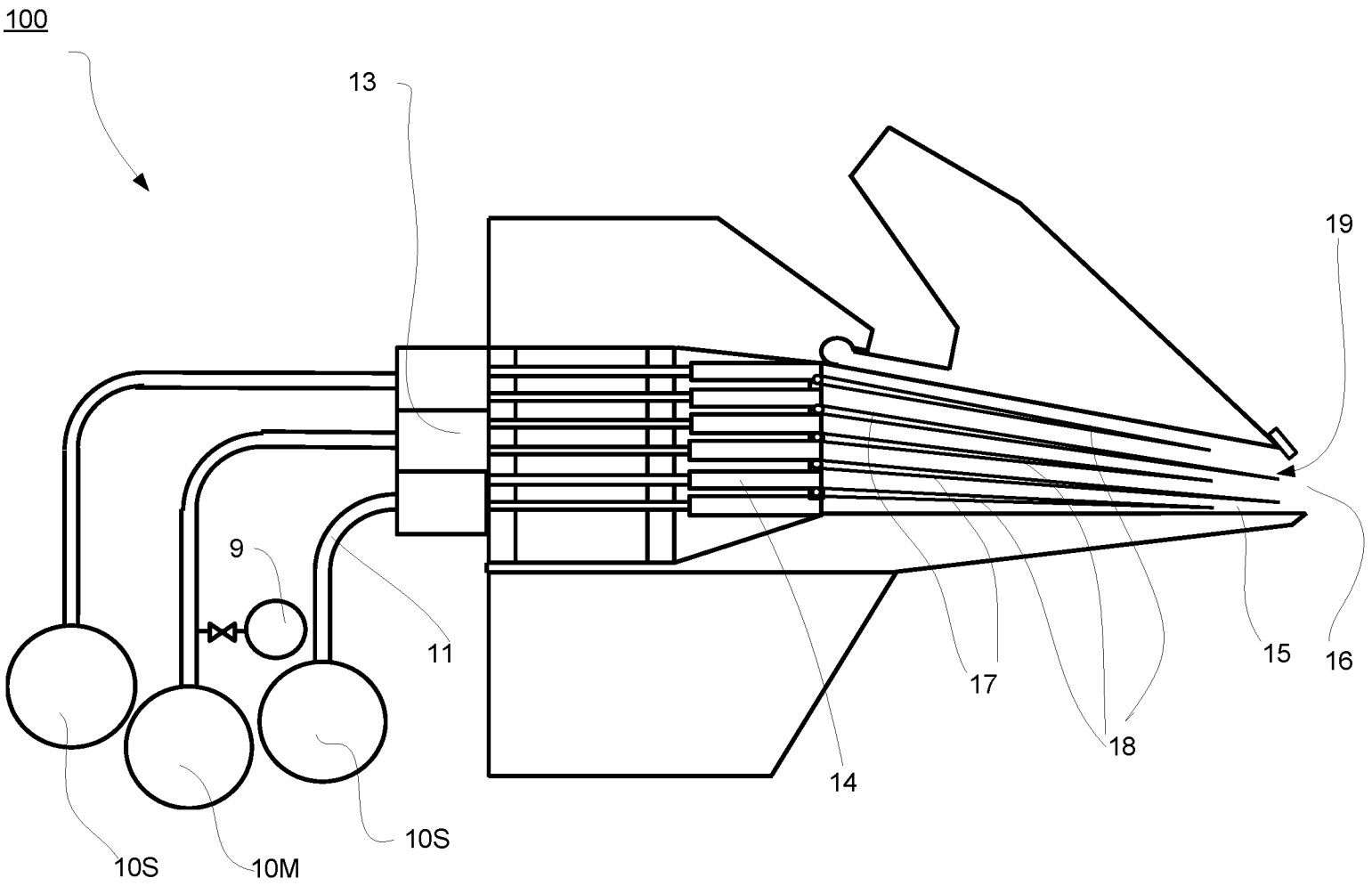
In FIG. 1 is shown schematically an advantageous example of a multilayer headbox of a forming section according to the invention.

In FIG. 1 is shown an example of a multilayer headbox 100 of the forming section. The multilayer headbox comprises headers 10S, 10M, from which the pulp suspensions for each layer of a three-layer board web are fed to manifold tubes 11 to an equalization chamber 13 and further via a turbulence generator 14 to slice channels 15 ending to a slice opening 16. Advantageously, the header 10M for the middle layer of the three-layer board web comprises a dilution control device 9. Also, the headers 10S for the surface layers of the three-layer board web may comprise a dilution control. In each slice channel 15 separation elements 17 and turbulence elements 18 are located. The separation and turbulence elements 17, 18 can be for example lamellas, vanes or wedges. In the slice channels 15 length of the separation elements 17 between each layer is longer than length of the turbulence elements 18 within each layer. Advantageously, the separation elements 17 extend close to the slice opening 16, the distance between end tip 19 of the separation element 17 and the slice opening 16 is advantageously 1-50 mm and turbulence elements 18 are typically 10-300 mm shorter than separation elements 17. Separation elements 17 end tip 19 is thin, advantageously tip thickness is less than 0.5 mm. Separation elements 17 keeps different stock suspensions separate and by thin tip stock suspension mixing is minimized.

Figure 2:
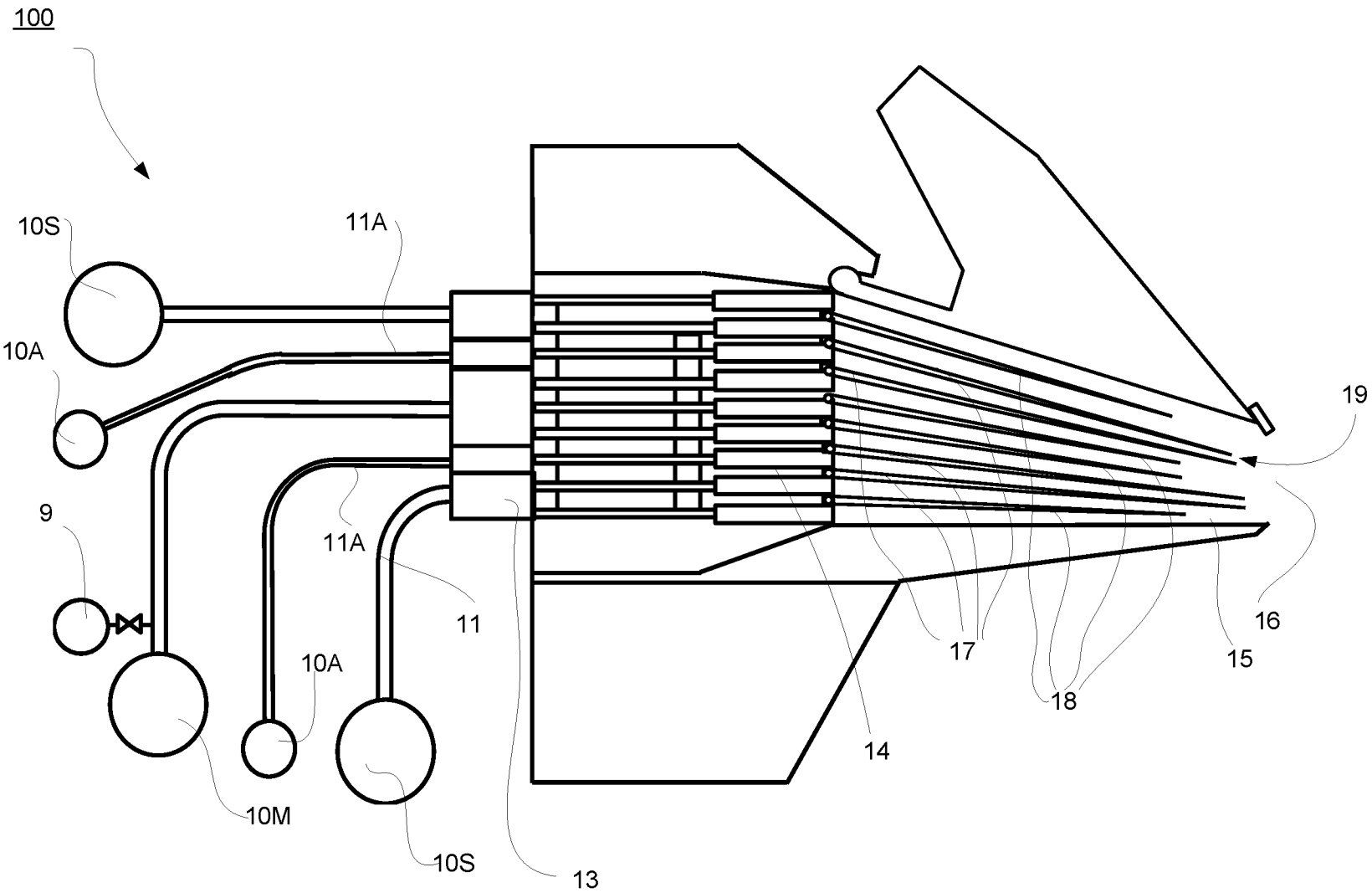
In FIG. 2 is shown schematically another advantageous example of a multilayer headbox of a forming section according to the invention.

In FIG. 2 is shown an example of a multilayer headbox 100 of the forming section. The multilayer headbox comprises headers 10M, 10S, from which the pulp suspensions for each layer of a three-layer board web are fed to manifold tubes 11 to an equalization chamber 13 and further via a turbulence generator 14 to slice channels 15 ending to a slice opening 16. Advantageously, the header 10M for the middle layer of the three-layer board web comprises a dilution control 9. Also, the headers 10S for the surface layers of the three-layer board web may comprise a dilution control device 20. In each slice channel 15 separation elements 17 and turbulence elements 18 are located. The separation and turbulence elements 17, 18 can be for example lamellas, vanes or wedges. In the slice channels 15 length of the separation elements 17 between each layer is longer than length of the turbulence elements 18 within each layer. Advantageously, the separation elements 17, extend close to the slice opening 16, the distance between end tip 19 of the separation element 17 and the slice opening 16 is advantageously 1-50 mm and turbulence elements 18 are typically 10-300 mm shorter than separation elements 17. Separation elements 17 end tip 19 is thin, advantageously tip thickness is less than 0.5 mm. Separation elements 17 keeps different stock suspensions separate and by thin tip stock suspension mixing is minimized. The multilayer headbox according to this example of the FIG. 2 is a so called Aqua-headbox, of which one example is described in EP-patent publication 2784213. Aqua-headers 10A are connected to corresponding distribution header 11A, which feeds white-water between the layers of the three-layer board web for forming an Aqua-layer between the layers of the three-layer board web. Additionally, the white-water may contain chemicals, fillers and/or fine substances. By the Aqua layer the layer purity is improved. Additionally, the inner strength of the three-layer board web can be improved ty the chemical, filler and/or fine substance additions between the layers of the three-layer board web. The aqua layer is combined to the stock suspension after the separation elements and by that way white-water prevents mixing of the stock suspensions.

Figure 3:
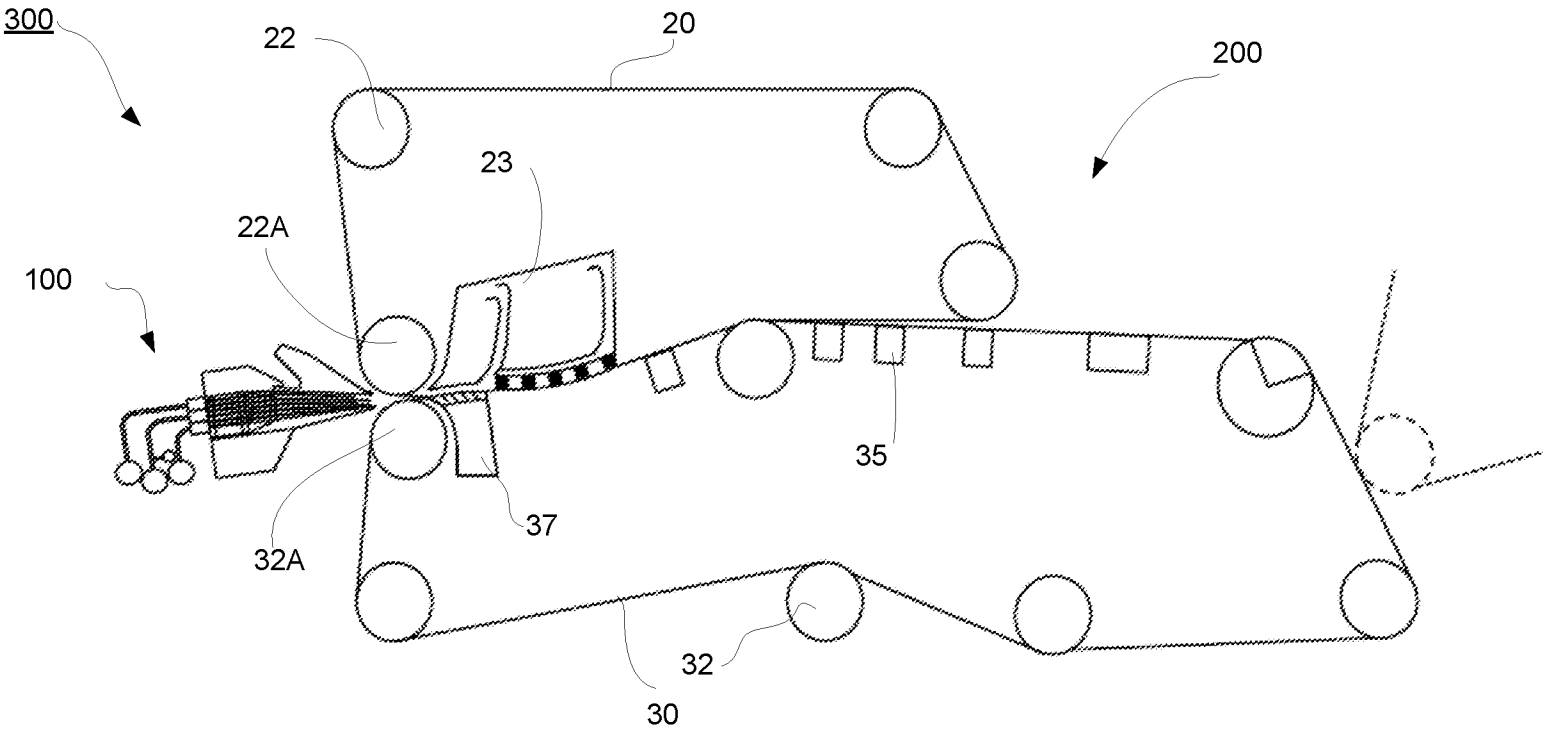
In FIG. 3 is shown schematically an advantageous example a forming section according to the invention.

In FIG. 3 is shown an example of the forming section 300 comprising a multilayer headbox 100 and a forming unit 200. The forming unit 200 of the example of the FIG. 3 is a so-called blade gap former. In the blade gap former first dewatering element is stationary forming shoe. The forming unit formed as a twin-wire forming unit comprising a lower wire 30 and an upper wire 20, each comprising rolls 32, 22 for guiding and driving the wire as an endless loop. The pulp suspension from the multilayer headbox 100 is first fed to the gap between the lower wire 30 and the upper wire 20 between the rolls 32A, 22A and onto the area of a forming shoe 37, which is advantageously under-pressured has advantageously a configured surface, for example curved, such that the forming shoe 37 does not cause substantial pressure pulses i.e. the forming shoe 37 is a so called non-pulsating forming shoe 37. Non-pulsating forming shoe 37 can be formed by cross machine direction lists which are arranged after each other with small distance. Advantageously lists width in machine direction is 4-15 mm and distance between lists is 4-15 mm. This kind of arrangement doesn't cause pressure pulsations, which could mix stock suspension. Dewatering happens on the forming shoe 37 on both directions and by that good layer purity of three-layer web is ensured. First dewatering on forming shoe 37 is gently, but effective and by that way dewatering capacity and web layer purity is ensured. Thereafter the pulp suspension between the lower wire 30 and the upper wire 20 is guided below a suction unit 23, located inside the loop of the upper wire. The forming shoe 37 removes water by suction, which provides for exact control of the headbox flow, so that water is sucked through the lower wire 30 but pulp suspension is not bouncing on the wire 30 as there is no pulsating water removal. The further water removal means of the forming unit 200 inside the loop of the lower wire 30 are suction boxes 35.

Figure 4:
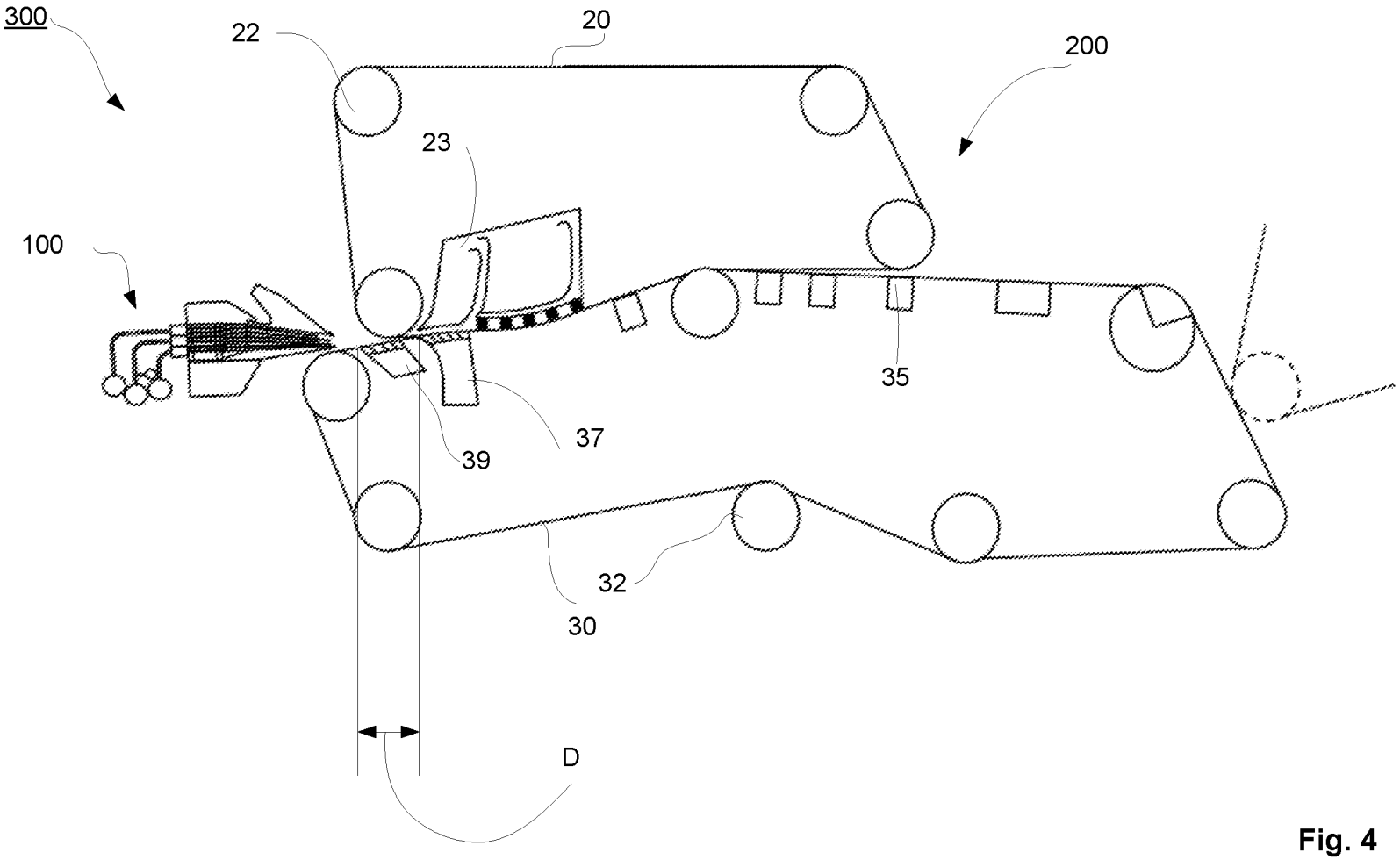
In FIG. 4 is shown schematically an advantageous example of a forming section according to the invention.

In FIG. 4 is shown an example of the forming section 300 comprising a multilayer headbox 100 and a forming unit 200. The forming unit 200 of the example of the FIG. 4 is a so-called combi former. Combi former contains short one wire section following twin-wire section. The pulp suspension from the multilayer headbox 100 is fed to the forming unit 200, in which at the beginning of the forming unit 200 is a short, advantageously 200-1500 mm long, substantially horizontal or inclined one-wire section comprising a forming shoe 39 removing water by suction, which provides for exact control of the headbox flow, so that water is sucked through the lower wire 30 but pulp suspension is not bouncing on the wire 30 as there is no substantially pulsating water removal. Length D of the one-wire section is measured from the beginning of the forming shoe 39 and between starting point of the twin-wire forming unit. The forming unit formed thereafter as a twin-wire forming unit comprises a lower wire 30 and an upper wire 20, each comprising rolls 32, 22 for guiding and driving the wire as an endless loop. The pulp suspension is led between the lower wire 30 and the upper wire 20 onto the area of a forming shoe 37, which is advantageously under-pressured has advantageously a configured surface, for example curved, such that the forming shoe 37 does not cause substantial pressure pulses i.e. the forming shoe 37 is a so called non-pulsating forming shoe 37. Non-pulsating forming shoe 37 can be formed by cross machine direction lists which are arranged after each other with small distance. Advantageously lists width in machine direction is 4-15 mm and distance between lists is 4-15 mm. This kind of arrangement doesn't cause pressure pulsations, which could mix stock suspension. Dewatering happens on the forming shoe 37 on both directions and by that good layer purity of three-layer web is ensured. Advantageously forming shoe 39 structure corresponds forming shoe 37 structure, but advantageously forming shoe 39 surface is straight. One wire section length is so short that web top side consistency is essentially at the headbox consistency when it is entering in the twin-wire forming unit. Thereafter the pulp suspension between the lower wire 30 and the upper wire 20 is guided below a suction unit 23, located inside the loop of the upper wire. The further water removal means of the forming unit 200 inside the loop of the lower wire 30 are suction boxes 35. This type of forming unit 200 allows lower running speeds, for example 300-400 m/min, as the pulp suspension flow from the multilayer headbox 100 is not flown first to the gap. An example of this type forming unit is disclosed in EP-patent publication 2841643.

In the description in the foregoing, although some functions have been described with reference to certain features and examples, those functions may be performable by other features and examples whether described or not. Although features have been described with reference to the certain examples, those features may also be present in other examples whether described or not.

Above only some advantageous examples of the inventions have been described to which examples the invention is not to be narrowly limited and many modifications and alterations are possible within the invention.

The invention claimed is:

1. A method for forming a three-layer board web, in a forming section comprising a multilayer headbox and a forming unit, the method including the steps of first forming the layers of the three-layer board web of pulp suspension in the multilayer headbox and then feeding the output from the multilayer headbox to only one forming unit, the forming unit being a gap former where the pulp suspension from the multilayer headbox is fed directly into a gap between lower and upper wires for joining the layers of the three-layer board web and for first water removal by a curved non-pulsating forming shoe adjacent the gap where dewatering happens on the curved non-pulsating forming shoe in both directions, wherein, after the curved non-pulsating forming shoe, pulp suspension between the lower wire and the upper wire is guided below a suction unit located inside a loop of the upper wire.

2. Method according to claim 1, wherein in the method white-water is fed between at least two layers of the three-layer board web in an Aqua-headbox.

3. Method according to claim 1, wherein the non-pulsating forming shoe comprises cross machine direction lists which are arranged after each other with cross machine direction lists width in machine direction being 4-15 mm and distance between lists being 4-15 mm.

* * * * *